US009968138B1

(12) United States Patent
Williams, Sr.

(10) Patent No.: US 9,968,138 B1
(45) Date of Patent: May 15, 2018

(54) FOOT SUPPORT DEVICE

(71) Applicant: Uganda Mugo Williams, Sr., Panama City Beach, FL (US)

(72) Inventor: Uganda Mugo Williams, Sr., Panama City Beach, FL (US)

( * ) Notice: Subject to any disclaimer, the term of this patent is extended or adjusted under 35 U.S.C. 154(b) by 0 days. days.

(21) Appl. No.: 15/293,649

(22) Filed: Oct. 14, 2016

(51) Int. Cl.
*A41B 11/02* (2006.01)
*A41B 11/00* (2006.01)

(52) U.S. Cl.
CPC ..... *A41B 11/02* (2013.01); *A41B 11/007* (2013.01)

(58) Field of Classification Search
CPC ..... A41B 11/02; A41B 11/007
See application file for complete search history.

(56) References Cited

U.S. PATENT DOCUMENTS 5,007,111 A * 4/1991 Adams ..... A41B 11/02 2/22
5,983,402 A * 11/1999 Fincher ..... A41B 11/002 2/239
6,606,750 B2 * 8/2003 Solwey ..... A41B 11/00 2/239
2006/0026740 A1 * 2/2006 Vargas ..... A41B 11/02 2/239
2006/0195971 A1 * 9/2006 Lambertz ..... A41B 11/00 2/239
2009/0276939 A1 * 11/2009 Sho ..... A41B 11/02 2/239
2014/0230131 A1 * 8/2014 Alston ..... A41B 11/007 2/239
2015/0201703 A1 * 7/2015 Baravarian ..... A41B 11/02 2/239
2016/0249687 A1 * 9/2016 Saeedi ..... A41B 11/02 2/239
2016/0366950 A1 * 12/2016 Thompson ..... A41B 11/02

* cited by examiner

*Primary Examiner* — Shaun R Hurley
*Assistant Examiner* — Andrew W Sutton
(74) *Attorney, Agent, or Firm* — Gulf Coast Intellectual Property Group

(57) ABSTRACT

A foot support device configured to be donned by a user and subsequently inserted into a shoe that is operable to provide impact reduction for a user. The foot support device includes a body having a first portion and a second portion contiguously formed. The body includes a cavity configured to receive a human foot therein. A bottom portion is secured to the second portion of the body and extends the length thereof. A void is present intermediate the bottom portion and the second portion of the body. Disposed within the void is an impact reduction member. The impact reduction member includes a first portion, a second portion and an expansion member. The expansion member is intermediate the first portion and second portion of the impact reduction member and is operable to allow the longitudinal extension of the impact reduction member.

13 Claims, 1 Drawing Sheet

FOOT SUPPORT DEVICE

FIELD OF THE INVENTION

The present invention relates generally to foot support devices, more specifically but not by way of limitation, a foot support device that is insertable into a shoe wherein the foot support device includes a sock member and an integrated impact reduction member wherein the impact reduction member is longitudinally extendable so as to accommodate various sizes of feet.

BACKGROUND

Millions of individuals experience some type of foot pain on a regular basis. Conditions such as but not limited to plantar fasciitis and other foot related ailments can be caused by various conditions and/or shoe types. Those individuals that spend a great deal of time on their feet for work often suffer from the aforementioned conditions which can create significant hardships and discomfort making it difficult to perform certain activities. It has been further shown that women have almost four times the chance of having some foot pain condition than men. A significant portion of this can be attributed to the shoe styles that women often wear.

One problem with existing foot pain treatment devices is they do not integrally form to the foot. Existing technologies such as but not limited to shoe inserts are typically placed within a shoe so as to reduce the impact pressure caused by walking or running. These inserts typically require to be cut by the user in order to attempt to achieve a desirable fit within the shoe. The inserts are typically manufactured from foam or a gel and superposed the interior surface of the sole of the shoe. There are several drawbacks to this design. First, as the insert is not secured within the shoe, these conventional shoe inserts will move within the interior of the shoe potentially causing discomfort for the user. Additionally, as many people routinely change shoes for different occasions, this requires that the user either purchase a set of inserts for each pair of shoes they intend to wear or transfer the insoles to the shoes that need to be worn by the user. The aforementioned options are both costly and/or inconvenient.

Accordingly, there is a need for a foot support device that is designed to be surroundably mounted to a foot so as to be worn within a shoe that does not impact the overall fit of the shoe. Further, the foot support device should include an integrally formed impact reduction member configured to be longitudinally adjustable so as to accommodate feet of various sizes.

SUMMARY OF THE INVENTION

It is the object of the present invention to provide a foot support device that is configured to provide impact reduction to a user wherein the foot support device includes a sock member.

Another object of the present invention is to provide a foot support device that includes an impact reduction member is integrally formed with the sock member.

A further object of the present invention is to provide a foot support device wherein the sock member includes a void intermediate the bottom section of the lower portion of the sock member and the upper section of the lower portion of the sock member.

An additional object of the present invention is to provide a foot support device configured to provide impact force reduction during walking and/or running wherein the impact reduction member is secured in the void intermediate the bottom section of the lower portion of the sock member and the upper section of the lower portion of the sock member.

Still another object of the present invention is to provide a foot support device configured to provide comfort to a user wherein the impact reduction member is manufactured from a foam or gel pad and further includes a center section.

Yet a further object of the present invention is to provide a foot support device wherein the center section of the impact reduction member is manufactured from a stretchable material.

Another object of the present invention is to provide a foot support device configured to provide impact reduction wherein the center section of the impact reduction member provides longitudinal expansion during donning of the foot support device so as to accommodate a foot of various lengths.

Still an additional object of the present invention is to provide a foot support device wherein the center section of the impact reduction member is operable remain in an extended position subsequent the foot support device being donned so as to maintain a length that ensures coverage of a foot inserted into the sock member.

A further object of the present invention is to provide a foot support device configured to provide impact reduction during wearing of a shoe wherein the sock member is manufactured in varying lengths.

Yet another object of the present invention is to provide a foot support device wherein the center section of the impact reduction member is secured using suitable durable techniques such as but not limited to stitching.

To the accomplishment of the above and related objects the present invention may be embodied in the form illustrated in the accompanying drawings. Attention is called to the fact that the drawings are illustrative only. Variations are contemplated as being a part of the present invention.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
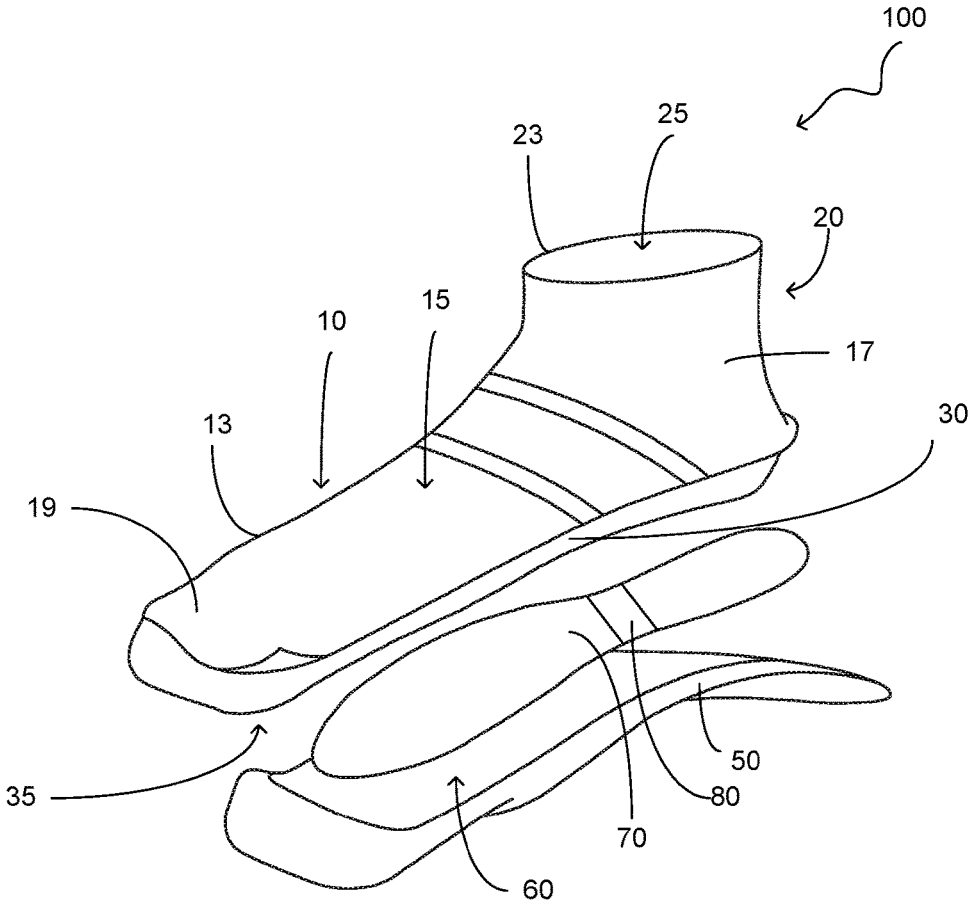
FIG. 1 is a perspective view of the present invention with the components thereof separated.
Figure 2:
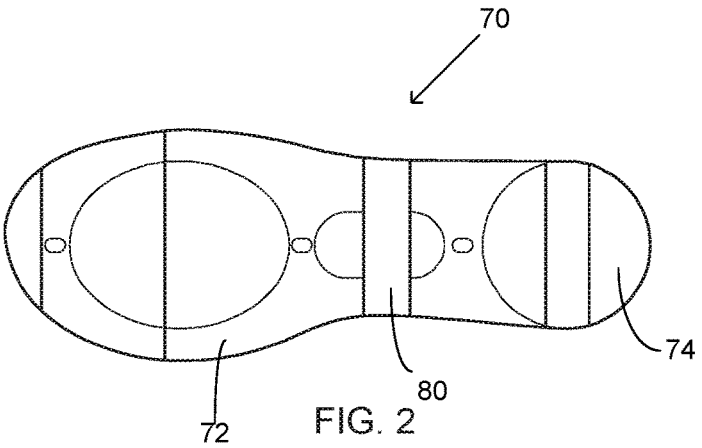
FIG. 2 is a top view of the impact reduction member of the present invention.

Referring now to the drawings submitted herewith, wherein various elements depicted therein are not necessarily drawn to scale and wherein through the views and figures like elements are referenced with identical reference numerals, there is illustrated a foot support device 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1, the foot support device 100 includes sock member 10 having body 15. Sock member 10 is manufactured from a suitable material such as but not limited to cotton and includes first portion 17 and second portion 19 which are integrally formed to create body 15. The body 15 includes a contiguous wall 13 forming a cavity (not illustrated herein) that facilitates the ability for the sock member 10 to receive a foot therein. Proximate the top 20 of the first portion 17 is opening 25. Opening 25 provides access to the cavity of the sock member 10 facilitating the insertion of a foot into the sock member 10. First portion 17 extends upward from second portion 19 and is configured to at least partially surround an ankle subsequent a foot being inserted into the sock member 10. While the first portion 17 has been illustrated herein as being manufactured in what is known in the art as a low-rise style, it is contemplated within the scope of the present invention that the first portion 17 could extend a greater length upwards from the second portion 19. By way of example but not limitation, it is contemplated within the scope of the present invention that the first portion 17 could be manufactured to a length such that the perimeter edge 23 is proximate a knee of a user subsequent donning of the foot support device 100.

The body 15 includes lower edge 30 that is contiguous with a bottom 35. A bottom portion 50 is secured to the sock member 10 using suitable durable techniques such as but not limited to stitching. The bottom portion 50 is manufactured from the same material as the sock member 10 and extends the complete length of the second portion 19. A void 60 is present intermediate the bottom portion 50 and the bottom 35. The void 60 functions to provide a suitable space for the impact reduction member 70.

Disposed within the void 60 is the impact reduction member 70. The impact reduction member 70 functions to provide a reduction in impact force to a bottom of a human foot that the foot support device 100. The impact reduction member 70 is sized so as to be substantially the same size as the bottom 35 of the second portion 19. The impact reduction member 70 is manufactured from a suitable material such as but not limited to gel and/or foam. The impact reduction member 70 includes a first portion 72 and a second portion 74 that are operably coupled via expansion member 80. As is known in the art, conventional socks are manufactured from a stretchable material so as to provide a sock that will accommodate a human foot within a particular size range. By way of example but not limitation, a sock is typically manufactured to accommodate a foot size from size seven to size ten. The sock member 10 of the present invention is manufactured similarly to conventional socks so as to provide the functionality of accommodating alternate sizes within a particular range.

The expansion member 80 provides the functionality to facilitate the longitudinal expansion of the impact reduction member 70 so as to correlate with the stretching of the sock member 10 in order to accommodate a human foot within a particular range. 80. The expansion member 80 provides the functionality of a first movement and a second movement. In a first movement during donning of the foot support device 100 the expansion member 80 extends so as to increase the length of the impact reduction member 70 if needed so as to accommodate a foot of a size that is towards the upper end of the range capacity of the foot support device 100. Additionally, as the expansion member 80 is resilient, a second movement is provided thereby wherein the expansion member 80 provides a retraction movement so as to adjust to the size of a foot disposed within the foot support device 100 upon the scenario wherein the expansion member 80 engaged in the first movement during donning of the foot support device 100 by a user.

The expansion member 80 is located just posterior of the center of the impact reduction member 70 as this area of the foot receives the least amount of load during a walking or running step. The expansion member 80 is manufactured from a stretchable material such as but not limited to nylon or spandex. The stretchable material of the expansion member 80 allows the impact reduction member 70 to remain generally the same length as the second portion 19 of the sock member 10 during the donning of the sock member 10 by a user that requires the stretching or expansion thereof to suitable surround the foot. As a user dons the foot support device 100, the sock member 10 will stretch to accommodate the foot. As the sock member 10 stretches in length to accommodate the foot, the expansion member 80 facilitates the lengthening of the impact reduction member 70 so as to ensure the impact reduction member 70 is positioned such that the impact reduction member 70 remains below the entire foot, from toes to heel, that has been inserted into the foot support device 100. The expansion member 80 is secured to the first portion 72 and second portion 74 utilizing suitable durable techniques such as but not limited to stitching or chemical adhesion. While only one expansion member 80 has been illustrated and discussed herein, it is contemplated within the scope of the present invention that the impact reduction member 70 could have more than one expansion member 80.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A foot support device configured to be donned by a user and further insertable into a shoe comprising:

a sock member, said sock member having a body, said body having an outer wall, said body having a cavity therein configured to accommodate a human foot, said body of said sock member having a first portion and a second portion, said body having a lower edge;

a bottom portion, said bottom portion being secured to said sock member proximate said lower edge, said bottom portion extending the length of said second portion of said body;

an impact reduction member, said impact reduction member being intermediate said bottom portion and said second portion of said body of said sock member, said impact reduction member being substantially the same length as said second portion of said body, said impact reduction member including a first portion and a second portion, said impact reduction member further including at least one expansion member intermediate said first portion and said second portion of said impact reduction member, said at least one expansion member being contiguous with said impact reduction member, said at least one expansion member being manufactured from a different material than said impact reduction member, said at least one expansion member extending laterally across said impact reduction member; and wherein said at least one expansion member facilitates the longitudinal expansion of said impact reduction member during the donning of the foot support device.

2. The foot support device as recited in claim 1, wherein said first portion of said body of said sock member extends upward from said second portion of said body of said sock member.

3. The foot support device as recited in claim 2, wherein said first portion of said body further includes an opening distal to said second portion of said body of said sock member.

4. The foot support device as recited in claim 3, wherein said expansion member is centrally located on said impact reduction member.

5. The foot support device as recited in claim 4, wherein said expansion member is manufactured from a stretchable material.

6. The foot support device as recited in claim 5, wherein said impact reduction member is manufactured from a group of material selected from one of the following: gel or foam.

7. A foot support device configured to be donned by a user and subsequently inserted into a shoe comprising:

a sock member, said sock member having a body, said body having an outer wall, said body having a cavity therein configured to accommodate a human foot, said body of said sock member having a first portion and a second portion, said first portion and said second portion being contiguously formed, said first portion extending upward from said second portion, said first portion having an opening, said second portion of said body having a lower edge, said lower edge extending the length of said second portion;

a bottom portion, said bottom portion being secured to said sock member proximate said lower edge, said bottom portion extending the length of said second portion of said body;

a void, said void being intermediate said bottom portion and said sock member;

an impact reduction member, said impact reduction member being disposed within said void, said impact reduction member being the same length as said second portion of said body, said impact reduction member having a first lateral edge and a second lateral edge, said impact reduction member including a first portion and a second portion, said impact reduction member further including an expansion member, said expansion member being manufactured from a stretchable and resilient material, said expansion member being intermediate said first portion and said second portion of said impact reduction member, said expansion member being linearly contiguous with said impact reduction member, said at least one expansion member extending intermediate said first lateral edge and said second lateral edge of said impact reduction member, said at least one expansion member being manufactured from a different material than said impact reduction member; and wherein said expansion member facilitates the longitudinal extension of said impact reduction member during the donning of the foot support device so as to maintain a length consistent with that of the second portion of said body of said sock member.

8. The foot support device as recited in claim 7, wherein said expansion member is centrally located on said impact reduction member.

9. The foot support device as recited in claim 8, wherein said expansion member facilitates a first movement and a second movement of the impact reduction member.

10. The foot support device as recited in claim 9, wherein said first movement of said expansion member is an extension movement.

11. The foot support device as recited in claim 10, wherein said second movement of said expansion member is a retraction movement.

12. The foot support device as recited in claim 11, wherein said impact reduction member is manufactured from a group of material selected from one of the following: gel or foam.

13. The foot support device as recited in claim 12, wherein said at least one expansion member is manufactured from a group of material selected from one of the following: nylon or spandex.

* * * * *